US005127846A

United States Patent [19]

Köllmann

[11] Patent Number: 5,127,846

[45] Date of Patent: Jul. 7, 1992

[54] TERMINAL BLOCK FOR ELECTRICAL CONDUCTORS

[75] Inventor: Hans-Josef Köllmann, Minden, Fed. Rep. of Germany

[73] Assignee: Wago Verwaltungsgesellschaft mbH, Minden, Fed. Rep. of Germany

[21] Appl. No.: 713,826

[22] Filed: Jun. 12, 1991

[30] Foreign Application Priority Data

Jun. 13, 1990 [DE] Fed. Rep. of Germany ..... 4019130

[51] Int. Cl.[5] ..... H01R 4/24

[52] U.S. Cl. ..... 439/441

[58] Field of Search ..... 439/436–441

[56] References Cited

U.S. PATENT DOCUMENTS

| | | | |
|---|---|---|---|
| 2,780,791 | 2/1957 | Morschel | 439/438 |
| 3,093,433 | 6/1963 | Ege | 439/441 |
| 3,152,851 | 10/1964 | McLaughlin | 439/441 |
| 3,569,911 | 3/1971 | Bogdanowicz | 439/441 |

*Primary Examiner*—Joseph H. McGlynn

*Attorney, Agent, or Firm*—Salter, Michaelson & Benson

[57] ABSTRACT

A terminal block includes two or more decks each of which has a clamping spring for receiving an electrical conductor therein. Each of the clamping springs is actuatable from the top portion of the terminal block by means of an actuator tool, and the decks are arranged in the form of a tower such that the clamping springs are equally superposed, lying one above the other. The tower arrangement allows the terminal block to occupy a minimal surface area on a conductor plate or the like.

5 Claims, 1 Drawing Sheet

FIG. 1
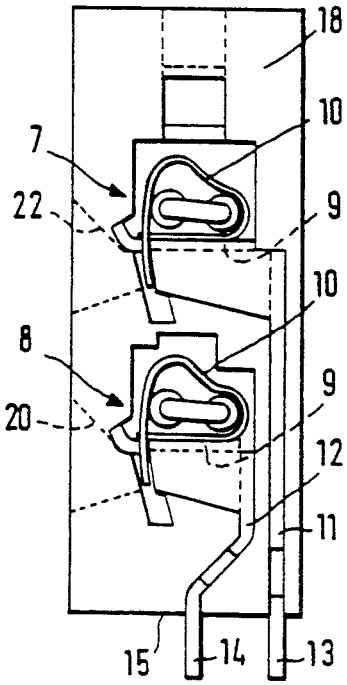
FIG. 2
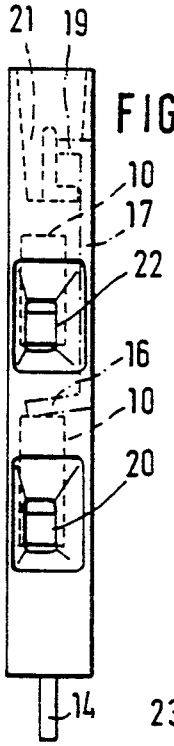
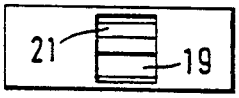
FIG. 3
FIG. 4
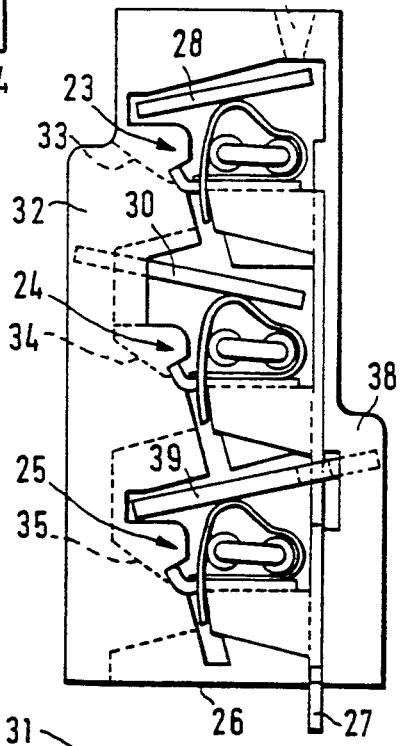
FIG. 5
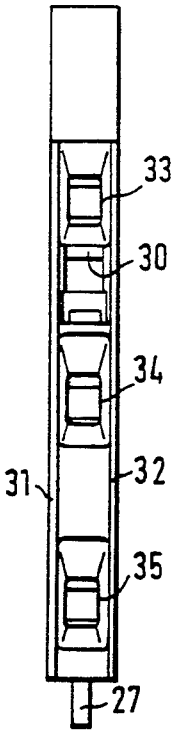
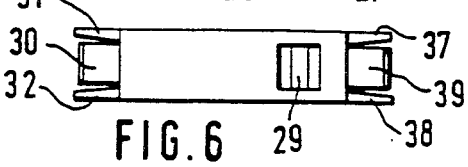
FIG. 6

TERMINAL BLOCK FOR ELECTRICAL CONDUCTORS

DESCRIPTION

The invention relates to a terminal block having two or more decks, each of which has at least one clamping spring for clamping an electrical conductor therein. Each of the clamping springs is actuable from the top portion of the terminal block by means of an actuating tool, such as a screwdriver, and the electrical conductors are introduced into the clamping springs from a side portion of the terminal block adjacent to the decks.

Terminal blocks of this type are particularly known as double terminal blocks. In order to be able to open the clamps of the respective lower decks from the top by means of an actuation tool, the clamps must be arranged such that the back of the clamp is displaced in an upper stage opposite the clamps in the following lower stage. In multi-stage construction of such terminal blocks, this brings about a considerable place requirement for the area (mounting surface) of such terminal blocks. This place requirement is not always available in devices in general or, e.g., in distributor and control plants or on conductor plates or in housings with integrated connection clamps (terminals) or the like.

The task of the invention is to technically instruct how terminal blocks of the type defined above must be constructed in order to arrive at a considerably smaller surface for such terminal blocks without adversely affecting the required individual actuation of the clamps arranged in the respective decks.

This task is resolved by the invention in that the clamping springs of the deck are arranged in a tower-like pattern, i.e., equally superimposed and lying over one another, and that at least the clamps of the decks which lie underneath the uppermost tower clamp are to be opened by means of an actuating crosspiece, which projects in the respective deck sideways with respect to the tower construction of the clamp such that it is to be actuated in the direction of the tower construction by means of the actuation tool.

The actuation crosspiece may be constructed as a footpiece of a slider, which can be guided and shifted in the direction of the tower construction in the insulated housing of the clamp tower and its head piece is to be actuated above the uppermost tower clamp by means of the actuator tool.

On the other hand, the actuation crosspiece may be formed alternatively as a power transmission lever, whose actuation end in the respective deck projects in front of or behind the tower construction of the clamps in the direction of conductor introduction.

The clamp tower of the invention may be constructed with clamps of the same or different potential. In any case it essentially remains true that such a clamp tower always requires less surface than the stage clamps of the prior art.

However, the individual actuation of the tower clamps is assured by the use of a slider or power transmission lever as an actuation crosspiece. Within the respective deck the actuation crosspiece displaces the actuation pressure point at which the actuation tool must be attached in order to open the respective clamp, projecting out somewhat from the tower construction of the clamps.

In case a slider is used, the actuation working point is drawn up over the uppermost tower clamp, so that e.g., in a two-deck clamp tower the uppermost clamp is opened directly and the clamp lying in the deck just below is opened by means of the slider. Such sliders, which are to be manufactured advantageously as flat sliders of plastic or of a very thin sheet-metal do not essentially enlarge the outer dimensions of the clamp tower of the invention.

Flat sliders are guided in the insulated housing of the clamp tower and are arranged appropriately on the respective sides of the clamp tower; they extend parallel to the direction of conductor introduction of the tower clamps. The so-called division width of a clamp tower, which is arranged in a row with several other similar type towers or may be mounted as one of the serial clamp towers on assembly rails or the like, is thus larger only by the respective thickness of the flat slider. In practice, with the use of one or two thin metal sliders, this is less than 1 mm.

If it is required that the so-called division width be maintained very small for the clamp tower of the invention, then the use of a power transmission lever advantageous; this requires no increase in width in the direction of the division width, but projects with its actuation end, (actuation pressure [working] point) in the respective deck in the direction of the conductor introduction in front of or behind the tower construction of the clamps. The slightly projecting actuation end thus projects, e.g. somewhat into the conductor connecting space in front of the clamp tower. However, since this conductor connecting space must be continually available for introducing the electrical conductor, the projecting actuation end of the power transmission lever causes no increase in the outer dimensions of the clamp tower.

In the instructions of the invention, it is advantageous that one tower makes four sides available, all of which may be utilized in order to arrange only a single clamp on one sie of the tower, i.e., to displace its actuation pressure point by means of the actuation crosspiece into the region of the respectively arranged tower side, so that the individual clamps of the respective deck are to be opened by means of the actuation tool constructively in a manner free of mistakes. If the uppermost tower clamp of a clamp tower is to be opened directly from the top by means of the actuation tool, then four stages underneath the uppermost tower clamp remain in all for the four tower sides. This produces a five-deck clamp tower, which stands on the smallest possible surface, but makes possible a mistake-free individual actuation of the individual deck clamps.

For practice, a particularly advantageous embodiment of the clamp tower of the invention is provided in that the terminal block has outer-lying guide channels for the actuation tool, i.e., a screwdriver, which channels extend in the direction of the tower construction and are arranged in the direction of conductor introduction in front of and/or behind the tower construction of the clamps, whereby the actuation ends (with the actuation pressure points) of the power transmission lever project into these guide channels.

The guide channels are appropriately made open throughout on their side turned away from the tower construction of the clamps, since they then serve simultaneously, in the direction of conductor introduction in front of the tower construction, for shortcircuit proof limiting of the conductor introduction space opposite possible neighboring clamp towers of the same type.

The actuation crosspiece described above in the form of a slider or in the form of a power transmission lever may be applied in mixed construction in one and the same clamp tower.

It is also possible that the actuation tool, does not directly act on the actuation end (actuation pressure point) of the power transmission lever, but a slider intermediate piece can be mounted first on this actuation end, whereby the actuation pressure point is displaced to the top by the length of the slider intermediate piece in the direction of the tower construction.

Two examples of embodiment of the invention will be described in more detail in the following on the basis of the drawings.

FIGS. 1–3 show the three views of a two-deck clamp tower;

FIGS. 4–6 show the three views of a three-deck clamp tower.

The clamp tower shown in FIGS. 1–3 has a connection clamp [terminal] 7 or 8 of the known structure each of its two decks. These connections clamps essentially consist of busbar 9 and clamp spring 10, which is constructed in the form of the cage tension spring developed by the Applicant (see for this German Patent 2,706,482).

Busbar 9 of connection clamps 7 and 8 are each joined via vertical conductor 11 or 12 to terminal lug 13 or 14, which project from surface 15 of the clamp tower, so that the latter can be mounted onto a conductor plate by soldering lugs 13 and 14.

According to the invention, connection clamps 7 and 8 are of tower shape, i.e., arranged equally superimposed and lying above one another, and the actuation, i.e., the opening of the lower connection clamp 8 is made by means of an actuation crosspiece, which can be more closely recognized from FIG. 2.

The actuation crosspiece is constructed as a footpiece 16 of a slider 17, which is guided and shifted in the direction of the tower construction in insulated housing 18 of the clamp tower and whose headpiece 19 is to be actuated above the upper connection clamp 7 by means of a screwdriver or the like. If the screwdriver compresses head piece 19 vertically down as shown in the illustration, then footpiece 16 is pressed onto the back of cage tension spring 10, so that the clamping position of connection clamp 8 opens for the electrical conductor (not shown), which is introduced from the side at the level of the lower deck via conductor introduction funnel 20 of the clamping position.

Another actuation opening 21 is found directly next to headpiece 19 of slider 17 in the upper part of the clamp tower, a screwdriver or the like can be inserted into this opening, and the screwdriver then presses with its tip onto the back of cage tension spring 10 of upper connection clamp 7 in order to open the latter in the same way for taking up an electrical conductor, which is introduced via conductor introduction funnel 22 in the upper deck of the clamp tower of the clamping position of connecting clamp 7.

It can be recognized that the clamp tower is extremely compactly constructed according to FIGS. 1-3 and has only a small surface 15, which requires little space on a conductor plate or another type of mounting and contact surface.

The three-deck clamp tower shown in FIGS. 4–6 has equally superimposed connection clamps 23, 24 and 25 lying over one another, which are constructed in the same way as connection clamps 7 and 8, but in contrast to connection clamps 7 and 8 of the example of embodiment according to FIGS. 1–3, all lie at the same potential, and correspondingly the clamp tower according to FIGS. 4—6 has only one connection or soldered lug 27 projecting above surface 26.

The three-deck clamp tower has an actuation crosspiece in each stage, which crosspiece is constructed as a power transmission lever. In the case of connection clamp 23, this lever 28, according to the illustration, is supported on the left side and extends with its actuation end to the top right, and it can be pressed to the bottom by means of a screwdriver or the like inserted through actuation opening 29 in order to open connection clamp 23.

In the middle deck, the connection clamp 24 is opened by means of power transmission lever 30, which, according to the illustration, is supported on the right side and extends with its actuation end to the upper left in a guide shaft, which is formed by the two side walls 31 and 32 in the example of the embodiment illustrated, as can be seen in FIG. 6.

This guide channel limits laterally to the one conductor introduction space in the direction of conductor insertion in front of the conductor introduction funnel 33 of the upper connection clamp 23 as well as in front of the two conductor introduction funnels 34 and 35 of the two lower connection clamps 24 and 25. The guide channel serves also particularly for guiding the actuation tool, which is in this case a screwdriver. The screwdriver is inserted from the top into the guide channel in the direction of the tower construction, and is reliably guided past an electrical conductor (not shown), possibly wired to the upper connection clamp 23 such that it engages without problem on the actuation end of power transmission lever 30, which projects into the guide channel (see FIG. 6). By depressing lever 30, connection clamp 24 is then opened in the described way.

The procedure is the same for opening the lower connection clamp 25. The actuation tool, i.e., the screwdriver is introduced from the top in the direction of the tower construction into the back guide channel of the clamp tower, which is formed by the two rear side walls 37 and 38 and into which projects the actuation end of power transmission lever 39, as can be seen in FIG. 6. Here again, connection clamp 25 is opened by depressing the actuation end of lever 39, so that an electrical conductor to be connected is introduced via conductor introduction funnel 35 without problem from the sides into the lower stage clamp of the clamp tower and may be clamped in this connection clamp.

It can be derived directly from the illustrations according to FIGS. 4—6 that in spite of the three-deck construction of the clamp tower of the invention, only a relatively small surface 26 is required for the mounting and the electrical connection of the clamp tower onto a conductor plate or another mounting and contact surface.

I claim:

1. A terminal block comprising two or more decks, each of which includes a clamping spring for receiving an electrical conductor therein, said clamping springs being downwardly depressible to an open position from a top of said terminal block through the use of a downwardly depressible actuator tool, said electrical conductors being introduced into said decks from a front of said terminal block at levels corresponding to the respective decks thereof, said decks being arranged in the form of a tower such that said clamping springs are superposed above one another, and such that said tower includes an uppermost deck and at least one lower deck, said terminal block further comprising at least one actuation crosspiece which at least partially projects laterally with respect to said tower into a lower deck such that said actuation crosspiece is actuatable in a downwardly displaceable manner by means of said actuator tool for opening the clamping spring of the respective deck thereof.

2. In the terminal block of claim 1, said actuation crosspiece comprising a slider having a footpiece, said slider being guided in a downwardly displaceable manner within said terminal block, said slider further having a headpiece which is disposed above the clamping spring of said uppermost deck and which is actuable by means of said actuator tool.

3. In the terminal block of claim 1, said at least one actuation crosspiece comprising a power transmission lever having an actuation end which extends at least partially laterally with respect to said tower outwardly of said terminal block from either the front thereof or from a back thereof.

4. The terminal block of claim 3, further comprising two adjacent lower decks each having a respective clamping spring and a respective power transmission lever, the actuation end of one of said power transmission levers projecting outwardly of said terminal block from the front thereof and the actuation end of the other of said power transmission levers projecting outwardly of said terminal block from the back thereof.

5. The terminal block of claim 3, further comprising at least one outer guide channel for guiding said actuator tool, said at least one guide channel extending outwardly from said terminal block, the actuation end of said at least one power transmission lever projecting outwardly of said terminal block into said at least one guide channel.

* * * * *